US008624140B2

(12) United States Patent
Nishino et al.

(10) Patent No.: US 8,624,140 B2
(45) Date of Patent: Jan. 7, 2014

(54) KEY SWITCH AND KEYBOARD

(75) Inventors: Takeshi Nishino, Shinagawa (JP); Junichi Maruyama, Shinagawa (JP); Shuji Nakamura, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 154 days.

(21) Appl. No.: 11/822,840

(22) Filed: Jul. 10, 2007

(65) Prior Publication Data

US 2008/0006516 A1 Jan. 10, 2008

(30) Foreign Application Priority Data

Jul. 10, 2006 (JP) ..... 2006-189726
Jul. 10, 2006 (JP) ..... 2006-189804
Jul. 10, 2006 (JP) ..... 2006-189825

(51) Int. Cl.
*H01H 13/06* (2006.01)

(52) U.S. Cl.
USPC ..... 200/302.2

(58) Field of Classification Search
USPC ..... 200/302.2, 344, 302.1, 341
See application file for complete search history.

(56) References Cited

U.S. PATENT DOCUMENTS 5,283,407 A * 2/1994 Pohl ..... 200/332
5,642,950 A * 7/1997 Hochgesang et al. ..... 200/302.2
6,376,789 B2 * 4/2002 Maruyama et al. ..... 200/344

FOREIGN PATENT DOCUMENTS

JP 09-306271 11/1997
JP 10-063394 3/1998
JP 2002-231090 8/2002
JP 2002-251937 9/2002
JP 2002-334627 11/2002
JP 2003-031067 1/2003

* cited by examiner

*Primary Examiner* — Felix O Figueroa
(74) *Attorney, Agent, or Firm* — Staas & Halsey LLP

(57) ABSTRACT

A key switch preferably used for a keyboard as an input device in electronic equipment. The key switch includes a base section; a key top disposed above the base section; a pair of link members interlocked to each other to support and direct the key top in a vertical direction relative to the base section; a switch member including a contact section capable of opening and closing in response to a vertical movement of the key top; and a biasing member capable of applying an elastic biasing force in a vertically upward direction to the key top. The key switch further includes a protection member disposed and inserted between the base section and the key top at a position where the protection member surrounds the pair of link members, the contact section and the biasing member. The protection member is elastically deformed to follow the vertical movement of the key top, and protects the pair of link members, the contact section and the biasing member from penetration of foreign matter.

7 Claims, 9 Drawing Sheets

KEY SWITCH AND KEYBOARD

BACKGROUND OF THE INVENTION

1. Field of the Invention

The present invention relates generally to a switch configuration for a keying operation, and more particularly to a key-entry switch device (hereinafter referred to as a key switch) preferably used for a keyboard incorporated as an input device in electronic equipment. The present invention also relates to a keyboard provided with a plurality of key switches.

2. Description of the Related Art

In a thinner or low-profile type keyboard, equipped for a portable electronic apparatus such as a notebook or palm-top personal computer, it is required to reduce the height of a key switch for a keying operation as well as to improve the operability and structural reliability of the key switch. The key switch usable in the low-profile keyboard typically includes a base section, a key top disposed above the base section, a pair of link members interlocked to each other to support and direct the key top in an upward-and-downward direction (or a substantially vertical direction), a switch member including a contact section capable of opening and closing in response to the vertical or upward-and-downward movement of the key top, and a biasing member capable of applying an elastic biasing force (i.e., an initial-position recovering force) in a vertically upward direction to the key top. The key top is movable substantially in the vertical direction relative to the base section, through an interlocking action of the link members, while keeping a predetermined posture of the key top.

Conventionally, in the above key switch, several types of link-member pairs have been used. For example, the first type pair of link members, which may be referred to as a gear-link type, are assembled together into a reverse V-shape as seen from a lateral direction (or in a side view) and meshed at toothed end regions thereof with each other (see, e.g., Japanese Unexamined Patent Publication (Kokai) No. 2003-031067 (JP-A-2003-031067)). The second type pair of link members, which may be referred to as a pantograph type, are assembled together into an X-shape as seen from a lateral direction (or in a side view) and rotatably or slidably joined at intersections thereof with each other (see, e.g., Japanese Unexamined Patent Publication (Kokai) Nos. 2002-231090 (JP-A-2002-231090), 2002-334627 (JP-A-2002-334627), and 2002-251937 (JP-A-2002-251937)). Also, a switch member which is widely used, is configured from a sheet-like switch including a pair of flexible circuit boards respectively carrying contacts in a mutually facing arrangement (referred to as a membrane switch sheet, in this application), the pair of contacts constituting a contact section capable of opening and closing.

The key switch further includes an actuating member making the contact section of the switch member open or close in response to the vertical movement of the key top. For example, the key switch disclosed in JP-A-2003-031067 uses a dome-shaped actuating member made of a rubber, which is disposed between the key top and the membrane switch sheet. When the key top reaches a lower limit position of the vertical movement, the actuating member acts to press, at the inner side of the dome top thereof, the membrane switch sheet, and thus makes the contact section close. On the other hand, the dome-shaped actuating member also acts as the above-described biasing member that is elastically deformed in response to the vertical downward movement of the key top, so as to apply the initial-position recovering force to the key top. In this key switch, during a keying operation of the key top, the actuating member (or the biasing member) is elastically deformed in a buckling manner due to the dome shape thereof, so that the elastic biasing force, non-linearly corresponding to the amount of depression of the key top, is applied to the key top, whereby ensuring unique keying operation properties involving a so-called click feeling.

The first pending technical situation relevant to the conventional key switches is described below. Due to a diversified environment for using a keyboard as an input device of an electronic apparatus, it is required that the keyboard be equipped with a protection structure for protecting an internal structure (e.g., an electrical contact section, a vertically guiding section, etc.) of each of the plurality of key switches installed in the keyboard from the penetration of foreign matter such as dust, liquid and the like. It is known that a separate cover member is provided, as the above-described protection structure, which is additionally or optionally fitted to the keyboard so as to entirely cover the key-arranging surface of the keyboard. However, due to the existence of the cover member, the keying operability for each key switch or the touch feeling of a finger may be deteriorated. Therefore, it is conventionally proposed that a protection function against the penetration of foreign matter is incorporated into the key switch.

For example, Japanese Unexamined Patent Publication (Kokai) No. 10-063394 (JP-A-10-063394) discloses a key switch including a key top slidably guided in a vertical direction relative to a base section, wherein a protection member (or a cup rubber) for preventing dust or liquid from penetrating an electric circuit inside the base section through a gap defined in a slide guide structure of the key top (which includes a tubular guide provided in the base section and a slider provided in the key top) is disposed between the base section and the key top. In this key switch, the cup rubber is a tubular element elastically deformable in response to the vertical downward movement of the key top, and acts to surround the slide guide structure, during vertical movement of the key top, so as to inhibit the penetration of dust or liquid into the base section. The cup rubber also acts, due to the elastic restoring force thereof, as a biasing member for applying an initial-position recovering force in an upward direction to the key top.

The key switch described in JP-A-10-063394 includes the slide-guide type key top frequently used in a keyboard having a normal size, i.e., not a low-profile type. The built-in cup rubber is configured to surround the columnar slide-guide structure formed by the tubular guide of the base section and the slider of the key top, while acting as the biasing member for returning the key top to the initial position. In this configuration, in which the region to be protected against the penetration of foreign matter has relatively narrow gap between the tubular guide and the slider, the protection function required to the cup rubber is not strict, and therefore, the cup rubber can also be used as the biasing member.

However, in the key switch used for a low-profile keyboard, as described in, e.g., JP-A-2003-031067 or JP-A-2002-231090, in which a supporting and directing structure for the key top is formed by a pair of link members interlocked with each other in an openable and closable manner about a mutually joining point, the movable sections of the supporting and directing structure exist in a relatively large area between the base section and the key top, and also a gap permitting an access to the contact section of the switch member (defined at, e.g., an engaging portion between the base section and the link member, an interacting portion between the contact section and the actuating member, etc.) is formed in a relatively large area of the base section. If foreign matter, such as dust, liquid, etc., penetrates the movable sections of the link members or the engaging portions between the base section and the link members, the keying operation properties of the key top may be affected, and, if foreign matter penetrates the interacting portion between the contact section of the switch member and the actuating member, the accuracy of the opening or closing action of the contact may be deteriorated. Therefore, it is required that a key switch used for a low-profile keyboard includes a more strict protection function against the penetration of the foreign matter into the internal structure.

The second pending technical situation relevant to the conventional key switches is described below. In conventional key switches, as described in JP-A-2003-031067 or JP-A-2002-334627, a pair of link members are assembled in an interlockable manner with each other and movably attached to both the base section and the key top. For example, in the key switch disclosed in JP-A-2003-031067, each link member is provided at a first end region thereof with a sliding axle slidably engaged with the base section and at a second end region thereof, opposite to the first end region, with a pivoting axle pivotably joined to the key top and a tooth meshable with a tooth of a counterpart link member in a gearing manner. Correspondingly, the base section is provided with slide support sections having guide grooves for respectively receiving the sliding axles of the link members, and the key top is provided with pivot support sections having bearing holes for respectively receiving the pivoting axles of the link members.

When assembling the key switch of JP-A-2003-031067, the pair of link members are laid on the base section in a flat state (i.e., in a state where the link members do not show the reverse V-shape, but show an opened shape along one plane), with their teeth being meshed with each other, and with their sliding axles being inserted into the respective guide grooves of the slide support sections of the base section. In this state, the key top is pressed onto the link members laid in the flat state, so as to fit the pivoting axles of the link members into the corresponding bearing holes of the pivot support sections of the key top. In order to enable this attachment procedure, the pivot support sections of the key top are provided with notches extending from their outer edges to the bearing holes. When attaching the key top, the pivoting axles of the link members are received in the notches of the pivot support sections and thereby the pivot support sections are elastically expanded, and then, the key top is further pressed on the link members, so as to fit the pivoting axles into the bearing holes in a snap-fit manner.

On the other hand, in the key switch disclosed in JP-A-2002-334627, a pair of link members are mutually joined at their central region in a relatively rotatable manner, and include a first link member that is provided at a first end region thereof with a sliding axle slidably engaged with the base section and at a second end region thereof, opposite to the first end region, with a pivoting axle pivotably joined to the key top, and a second link member that is provided at a first end region thereof with a pivoting axle pivotably joined to the base section and at a second end region thereof, opposite to the first end region, with a sliding axle slidably engaged with the key top. Correspondingly, the base section is provided with a slide support section having a guide groove for receiving the sliding axle of the first link member and a pivot support section having a bearing groove for receiving the pivoting axle of the second link member, while the key top is provided with a pivot support section having a bearing groove for receiving the pivoting axle of the first link member.

Further, the key switch of CP-A-2002-334627 includes an actuator attached to the inner surface of the key top. The actuator includes a pivot support section having a bearing groove for receiving the pivoting axle of the first link member in an auxiliary manner, and a slide support section having a guide groove for receiving the sliding axle of the second link member. According to this configuration, when a force is applied to the key top in a direction detaching the key top from the first and second link members, the force is dispersed so as to reduce damage that may otherwise occur in the respective pivot and slide support sections.

In the key switch of JP-A-2003-031067, in order to improve operability for attaching the key top to the pair of link members, the pivot support sections of the key top are provided respectively with notches extending from the outer edges to the bearing holes. These notches act to allow the pivoting axles of the link members to be easily fitted into the bearing holes in a snap-fit manner, but may allow the key top to be easily detached from the link members.

In particular, when external force is applied to the outer periphery of the key top in a direction pulling-up the key top apart from the base section, the key switch having the link members of the gear-link type shows geometrical properties such that, with regard to a force point (i.e., the outer periphery of the key top), a fulcrum (i.e., one pivot support section farther from the force point) and an application point (i.e., another pivot support section closer to the force point), a ratio of a distance between the fulcrum and the application point to a distance between the force point and the fulcrum is relatively small, and therefore, a force generated at the application point (i.e., a force acting to detach the pivot support section closer to the force point from the pivoting axle of the link member) becomes relatively large. As a result, the pivoting axle may be disengaged from the bearing hole while expanding the notch, and the key top thus may be detached from the link members. Further, a relatively large amount of application force may damage the pivot support section.

In contrast to this, in the key switch of JP-A-2002-334627, due to the provision of the actuator attached to the inner surface of the key top, when force is applied to the key top in a direction detaching the key top from the first and second link members, it is possible to stop damage that may occur in the pivot and slide support sections. However, in the link members of the pantograph type in JP-A-2002-334627, a distance between the support sections (i.e., the pivot support section and the slide support section) on the key top for movably supporting the pair of link members is considerably larger than a distance between the support sections (i.e., the pivot support sections) on the key top for the link members of the gear-link type in JP-A-2003-031067, and therefore, when the external force is applied to the outer periphery of the key top to pull-up the key top apart from the base section as described above, a disengaging force generated at an application point (i.e., the pivot support section or the slide support section) is considerably smaller than a disengaging force that may be assumed in the case of the link members of the gear-link type.

As a result, in the key switch in JP-A-2002-334627, the pivot support section formed in the key top is provided with the bearing groove for directly receiving, in a temporarily retaining manner, the pivoting axle of the first link member, and the pivot support section of the actuator is also provided with the bearing groove for assisting the temporarily retaining function of the direct pivot support section of the key top. In this configuration, if a large disengaging force occurs, which is assumed in the link members of the gear-link type, the key top may be detached from the link member.

The third pending technical situation relevant to the conventional key switches is described below. Due to a diversified environment for using a keyboard as an input device of an electronic apparatus, in the provision of a plurality of key switches in the keyboard, a key switch having a so-called backlight configuration is known, as disclosed in JP-A-2002-251937, in which a marked region defined by, e.g., a character, a symbol, etc., formed in the key top is illuminated from the interior of the key switch, so as to improve the operability of the keyboard in a dark environment. In the key switch of JP-A-2002-251937, a light-emitting section having a LED (light-emitting diode) or EL (electro-luminescence) element is disposed on or below a membrane switch sheet constituting a switch member.

In association with the key switch having the backlight configuration, Japanese Unexamined Patent Publication (Kokai) No. 9-306271 (JP-A-9-306271) discloses a switch for operating a cursor, which has a basic structure different from that of the key switch subject to the keying operation, and which includes a rubber cap for preventing light emitted from the light-emitting section disposed beneath the key top from escaping laterally through a gap between the key top and the base section. The cursor-operating switch of JP-A-9-306271 includes a switch body having a manipulating shaft operable in a pivoting manner into an inclined posture, a key top joined to the manipulating shaft of the switch body, a light-emitting element attached to the switch body, and a cap disposed between the key top and a front plate covering the switch body so as to surround the manipulating shaft. Even when the key top is operated in an inclined manner, the cap closes the gap between the key top and the front plate, thereby preventing light emitted from the light-emitting device from escaping laterally.

In the key switch having the backlight configuration as described in JP-A-2002-251937, it is important to permit the light emitted from the light-emitting section to efficiently reach the marked region of the key top. In this connection, the cursor-operating switch of JP-A-9-306271 includes the cap for preventing the lateral escape of the light emitted from the light-emitting section, but this cap is intended to be installed in the key top of the inclinational type, and it is not considered to apply the cap to the key switch subject to the keying operation.

In particular, in the key switch used for the low-profile keyboard, which includes a pair of link members interlocked with each other in an openable and closable manner so as to act as a support and direct structure for the key top, an opening region formed in the base section is defined in a relatively large area of the base section (e.g., an engaging portion between the base section and the link member, an interacting portion between the contact section and the actuating member, etc.), so that it is necessary to reliably prevent light emitted from the light-emitting section from diffusing through the opening region. Therefore, it is required for the key switch used in the low-profile keyboard to ensure a high-level internal light-shielding function making it possible to more reliably prevent light emitted from the light-emitting section from escaping out from the key switch and permitting the emitted light to efficiently reach the marked region of the key top.

SUMMARY OF THE INVENTION

It is an object of the present invention to provide a key switch including a pair of link members for supporting and directing a key top in a vertical direction relative to a base section, and possessing a protection function making it possible to reliably and stably prevent foreign matter from penetrating an internal structure of the key switch.

It is another object of the present invention to provide a key switch including a pair of link members having a gear-link configuration for supporting and directing a key top in a vertical direction relative to a base section, and capable of properly maintaining a mutually joined configuration of the key top and the link members against a force acting to detach the key top from the link members, and preventing a pivot support section formed on the key top from being damaged due to the detaching force.

It is a further object of the present invention to provide a key switch having a backlight configuration, including a pair of link members for supporting and directing a key top in a vertical direction relative to a base section, and possessing a high-level internal light-shielding function making it possible to reliably prevent light emitted from a light-emitting section from escaping, and permitting the emitted light to efficiently reach a marked region of the key top.

It is a yet further object of the present invention to provide a keyboard including a plurality of key switches and having a low-profile configuration, which also has excellent operability and structural reliability.

To accomplish the above object, the present invention provides a key switch comprising a base section; a key top disposed above the base section; a pair of link members interlocked to each other to support and direct the key top in a vertical direction relative to the base section; a switch member including a contact section capable of opening and closing in response to a vertical movement of the key top; a biasing member capable of applying an elastic biasing force in a vertically upward direction to the key top; and a protection member disposed and inserted between the base section and the key top at a position where the protection member surrounds the pair of link members, the contact section and the biasing member; the protection member being elastically deformed to follow the vertical movement of the key top and protecting the pair of link members, the contact section and the biasing member from penetration of foreign matter.

In the above-described key switch, the protection member may have properties such as to be deformed to follow the vertical movement of the key top without affecting a keying operation feeling given by the elastic biasing force of the biasing member.

The present invention also provides a key switch comprising a base section; a key top disposed above the base section; a pair of link members interlocked to each other to support and direct the key top in a vertical direction relative to the base section; a switch member including a contact section capable of opening and closing in response to a vertical movement of the key top; and a link support member attached to the key top and pivotably supporting the pair of link members; the pair of link members being provided at respective one-end regions thereof with teeth meshable with each other in a gearing manner and pairs of pivoting axles pivotably joined to the link support member; the link support member including two pairs of bearing holes respectively receiving the pairs of pivoting axles of the pair of link members, each of the bearing holes being formed as a through hole with no notch in a periphery thereof.

In the above-described key switch, the link support member may include a major plate portion and a pair of opposing wall portions provided along a pair of edges of the major plate portion and generally parallel with each other, each of the opposing wall portions being provided with two of the bearing holes, and the major plate portion having elasticity permitting a pair of pivoting axles of each of the pair of link members to be received correspondingly in the bearing holes provided in the pair of opposing wall portions.

The present invention further provides a key switch comprising a base section; a key top disposed above the base section and including an optically transparent marked region; a pair of link members interlocked to each other to support and direct the key top in a vertical direction relative to the base section; a switch member including a contact section capable of opening and closing in response to a vertical movement of the key top; a light-emitting section provided in the base section and generating light transmitted through the marked region of the key top; and a light-shielding member disposed and inserted between the base section and the key top at a position where the light-shielding member does not interfere with a propagation of the light from the light-emitting section to the marked region; the light-shielding member being deformed to follow the vertical movement of the key top and preventing the light from escaping through a gap between the base section and the key top.

In the above-described key switch, further comprising a biasing member capable of applying an elastic biasing force in a vertically upward direction to the key top, the light-shielding member may have properties, such as to be deformed to follow the vertical movement of the key top without affecting a keying operation feeling given by the elastic biasing force of the biasing member.

The present invention yet further provides a keyboard comprising a plurality of key switches in an array, each of the key switches being described above.

BRIEF DESCRIPTION OF THE DRAWINGS

The above and other objects, features and advantages of the present invention will become more apparent from the following description of preferred embodiments in connection with the accompanying drawings, wherein.

DESCRIPTION OF THE PREFERRED EMBODIMENT

Figure 1:
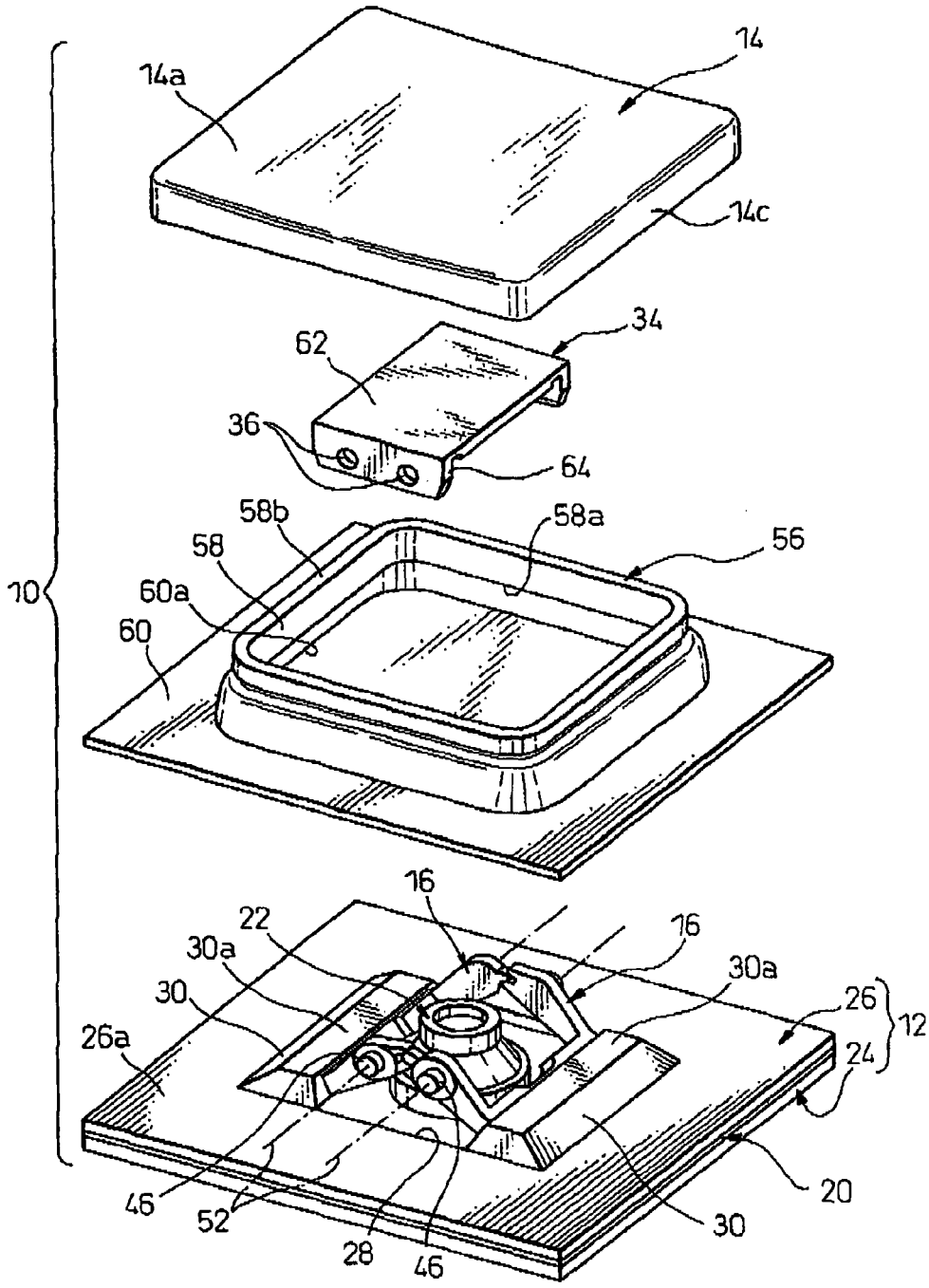
FIG. 1 is an exploded perspective view showing a key switch according to an embodiment of the present invention.

The embodiments of the present invention are described below in detail, with reference to the accompanying drawings. In the drawings, the same or similar components are denoted by common reference numerals.

Figure 2:
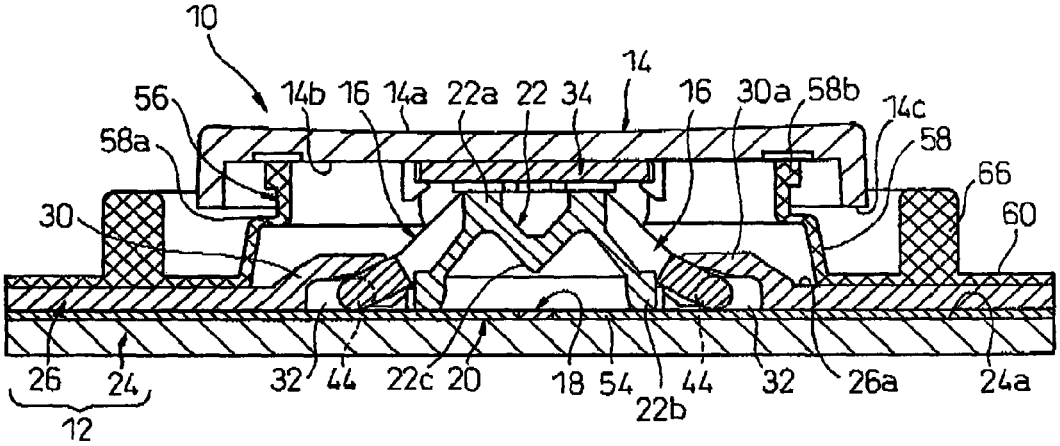
FIG. 2 is a sectional view showing the key switch of FIG. 1 in an assembled state wherein a key top is not operated.
Figure 3:
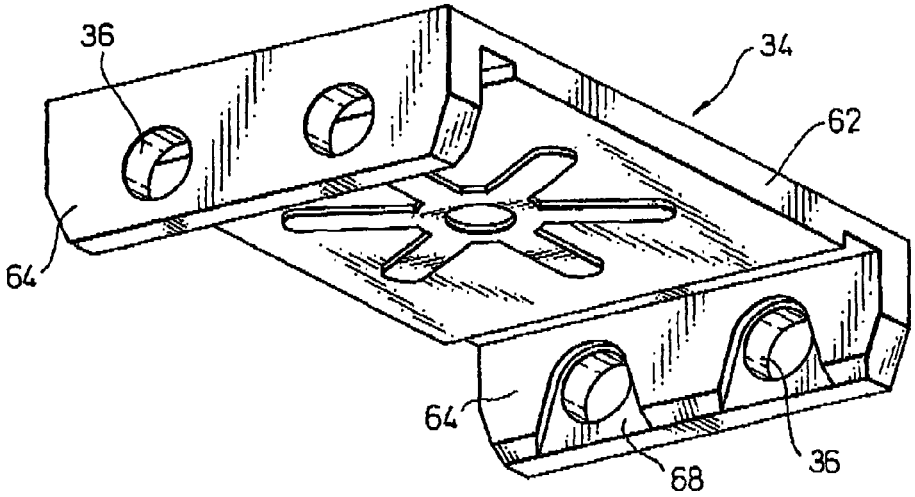
FIG. 3 is an enlarged perspective bottom-side view showing a link support member used in the key switch of FIG. 1.
Figure 4:
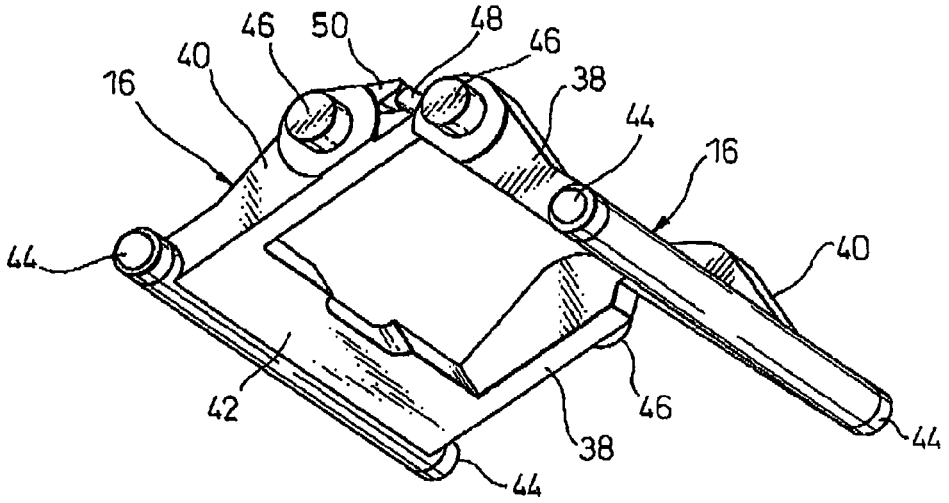
FIG. 4 is an enlarged perspective bottom-side view showing a pair of link members used in the key switch of FIG. 1.
Figure 5:
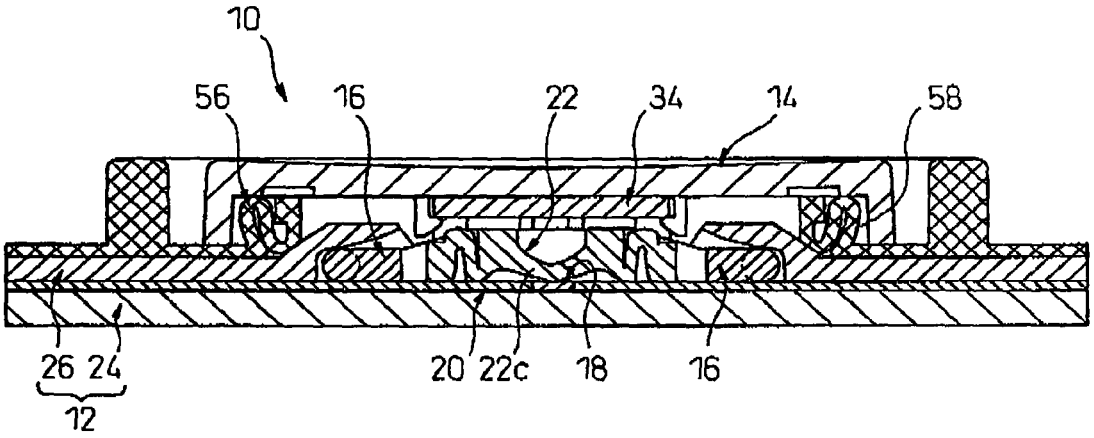
FIG. 5 is a sectional view showing the key switch of FIG. 1 in an assembled state wherein a key top is operated.

Referring to the drawings, FIG. 1 is an exploded perspective view showing a key switch 10 according to an embodiment of the present invention; FIG. 2 is a sectional view showing the key switch 10 in an assembled and non-operated state; FIGS. 3 and 4 are enlarged views of various components of the key switch 10; and FIG. 5 is a sectional view showing the key switch 10 in an assembled and operated state. The key switch 10 can be preferably used for a thin or low-profile keyboard provided in a portable electronic apparatus such as a notebook or palmtop personal computer and the like.

As shown in FIGS. 1 and 2, the key switch 10 includes a base section 12; a key top 14 disposed above the base section 12; a pair of link members 16 interlocked to each other to support and direct the key top 14 in an upward-and-downward direction (i.e., a substantially vertical direction) relative to the base section 12; a switch member 20 including a contact section 18 of an electric circuit, capable of opening and closing in response to an upward-and-downward movement (i.e., a vertical movement) of the key top 14; and a biasing member 22 capable of applying an elastic biasing force in a vertically upward direction (i.e., an initial-position recovering force) to the key top 14. The key top 14 is movable in the vertical direction relative to the base section 12, through an interlocking action of the link members 16, while keeping a predetermined posture of the key top 14.

The base section 12 includes a rigid and flat first support plate 24 functioning as a structural base of the key switch 10, such as a separate metallic shin-plate made of a sheet metal material or a resinous bottom panel of a keyboard into which the key switch 10 is incorporated, and a frame-like second support plate 26 disposed on the first support plate 24 and formed as, e.g., an integrally molded unitary piece made of a resinous material. The second support plate 26 includes a generally rectangular opening 28 adapted to be substantially covered or shaded by the key top 14. Along a pair of opposed inner edges defining the opening 28, a pair of slide support sections 30 are provided to be apart from each other in a link sliding direction (in a leftward-and-rightward direction in FIG. 2). Each slide support section 30 includes a wall portion 30*a* extending from an upper surface 26*a* of the second support plate 26 to overhang the opening 28. A pair of guide grooves 32 are formed inside each wall portion 30*a* at opposite longitudinal ends thereof, to extend generally parallel to the upper surface 26. The guide grooves 32 provided in each slide support section 30 act to slidably receive the first end (i.e., bottom end) region of each link member 16 as described later.

Alternatively, the base section 12 may also be configured, without using the second support plate 26, so that the first support plate 24 acts to directly guide and support the link members 16. In this arrangement, the first support plate 24 is provided on the upper surfaces 24*a* thereof with slide support sections (not shown) having guiding holes for slidably guiding the first end (bottom end) regions of the respective link members 16, in place of the slide support sections 30 described above. Further, as described later, the base section 12 may be provided with a light-emitting structure for illuminating a marked region, such as a character, a symbol, etc., provided on the key top 14, from the interior of the key switch.

The key top 14 is a dish-like member having a generally rectangular shape as seen in a plan view and, e.g., integrally molded into a unitary member from a resinous material, and includes an operating surface 14*a* subjected to a keying operation by an operator and an inner surface 14*b* opposite to the operating surface 14*a*. A link support member 34 is attached to the inner surface 14*b* of the key top 14, for pivotably supporting the second end (i.e., top end) regions of the respective link members 16 as described later. As shown in FIG. 3, the link support member 34 is provided with two pairs of bearing holes (i.e., pivot support sections) 36 for respectively receiving axles (described later) provided at the second end regions of the respective link members 16. The link support member 34 is securely mounted on the inner surface 14*b* of the key top 14 in an orientation such that the two pairs of bearing holes 36 are apart from each other in the link sliding direction (in the leftward-and-rightward direction in FIG. 2). The configuration of the link support member 34 will be described in more detail later.

Alternatively, the key top 14 may also be configured, without using the link support member 34, so that the inner surface 14*b* is directly joined to the link members 16. In this arrangement, the key top 14 is provided on the inner surface 14*b* thereof with pivot support sections (not shown) for pivotably receiving the second end (top end) regions of the respective link members 16, in place of the bearing holes 36 described above.

A pair of link members 16 have shapes and dimensions identical to each other, and are assembled together into a reverse V-shape as seen in a lateral direction or a side view, and meshed at one end regions thereof with each other in a gearing manner. Each link member 16 is formed as, e.g., an integrally molded unitary piece made of a resinous material. As shown in FIG. 4, the link member 16 includes integrally a pair of arms 38, 40 extending generally parallel to each other and a trunk 42 interconnecting the arms 38, 40 with each other. In the illustrated embodiment, in each of the link members 16, the end regions of the arms 38, 40 adjoining the trunk 42 are defined as a first end (or bottom end) region of the link member 16, and the distal end regions of the arms 38, 40 extending from the trunk 42 are defined as a second end (or top end) region of the link member 16.

In the first end region of each link member 16, a pair of sliding axles 44 are provided to project coaxially with each other from the mutually facing-away outer sides of the arms 38, 40 and oppositely to the trunk 42. In the second end region of each link member 16, a pair of pivoting axles 46 are provided to project coaxially with each other from the outer sides of the arms 38, 40 in the same direction as the sliding axles 44.

Each of the sliding axles 44 and pivoting axles 46 has a cylindrical shape. Further, on one arm 38 of each link member 16, one tooth 48 is provided on the distal end surface of the second end region proximal to the pivoting axle 46, and on the other arm 40, two teeth 50 are provided on the distal end surface of the second end region proximal to the pivoting axle 46.

Each link member 16 is disposed between the base section 12 and the key top 14 so that the pair of sliding axles 44 in the first end region are slidably fitted into the corresponding guide grooves 32 of the slide support section 30 provided on the second support plate 26 of the base section 12 and the pair of pivoting axles 46 in the second end region are pivotably fitted into the corresponding bearing holes 36 provided in the link support member 34 of the key top 14. The pair of link members 16 are configured to form an interlocking structure in which one tooth 48 of the respective one arm 38 is meshed with two teeth 50 of the respective other arm 40, thereby rotatable in a mutually interlocking manner about respective pivot axes 52 (FIG. 1) defined by the pivoting axles 46 of the arms 38, 40.

Thus, when the link members 16 synchronously rotate in opposite directions about respective pivot axes 52 (i.e., about the respective rotatable engagement points between the pivoting axles 46 and the bearing holes 36) and the respective first end regions slide in a generally horizontal direction under the guiding action of the corresponding slide support sections 30 of the base section 12 (i.e., under the sliding engagement between the sliding axles 44 and the guide grooves 32), the key top 14 is subjected to a parallel displacement in a generally vertical direction relative to the base section 12, while maintaining a predetermined, generally horizontal posture of the key top 14 in which the operating surface 14*a* is substantially parallel with the upper surface 26*a* of the base section 12 (or the second support plate 26). The upper limit position of the keying stroke (i.e., the stroke of the vertical movement) of the key top 14 is determined when the sliding movement of the first end regions of the link members 16 toward each other is stopped by the surrounding walls of the guide grooves 32 of the corresponding slide support sections 30 of the base section 12 (see FIG. 2). As the key top 14 descends from this upper limit position, the first end regions of the link members 16 slide, under the guiding action of the guide grooves 32 for the sliding axles 44, away from each other in a direction generally orthogonal to the direction of vertical movement of the key top 14. When the key top 14 reaches the lower limit position of the keying stroke, the contact section 18 of the switch member 20 is closed (see FIG. 4).

The switch member 20 includes a membrane switch sheet 54 disposed adjacent to the base section 12 and carrying the contact section 18 at a position beneath the key top 14. The membrane switch sheet 54 includes a pair of flexible circuit boards respectively carrying a pair of contacts to face to each other (not shown), and a sheet-like spacer supporting these circuit boards with a predetermined gap defined therebetween to maintain the contacts in an opened state. The contacts are patterned on the surfaces of film substrates of the circuit boards and constitute the contact section 18 of the switch member 20. The membrane switch sheet 54 is inserted and supported between the first support plate 24 and the second support plate 26 of the base section 12, and the contact section 18 is positioned generally at the center of the opening 28 of the second support plate 26.

The biasing member 22 is a dome-shaped member integrally molded into a unitary piece from a rubber material, and is disposed between the key top 14 and the membrane switch sheet 54 with the dome top 22*a* facing toward the key top 14. The biasing member 22 is disposed in the opening 28 of the second support plate 26 of the base section 12 and fixed to the membrane switch sheet 54, at the bottom dome-open end 22*b* of the biasing member. When no load is applied to the biasing member 22, the dome top 22*a* of the biasing member 22 is upwardly spaced from the membrane switch sheet 54. On the inner surface of the dome top 22*a* of the biasing member 22, a projection 22*c* is formed to be aligned with the contact section 18 of the membrane switch sheet 54, for pressing and closing the contact section 18 when the key top 14 is depressed.

In the key switch 10, when no external force is applied to the key top 14, the biasing member 22 biases the key top 14 toward and supports it, by the dome top 22*a*, at the upper limit position of the stroke vertically above and apart from the base section 12 (FIG. 2). At this time, the contact section 18 of the membrane switch sheet 54 is in an opened state. When the key top 14 is depressed by a keying operation, the biasing member 22 is elastically deformed in response to the downward movement of the key top 14, while exerting an elastic biasing force (or an initial-position recovering force) to the key top 14 in an upward direction, and presses by the inside projection 22*c* the membrane switch sheet 54 from the outside thereof, at the instant when the key top 14 reaches the lower limit position of the stroke, so as to close the contact section 18 (FIG. 4). When the depressing force to the key top 14 is released, the biasing member 22 is elastically restored so as to return the key top 14 to the upper limit position, and thereby the membrane switch sheet 54 is restored to open the contact section 18. As will be understood from the above, the biasing member 22 also functions as an actuating member for making the contact section 18 of the switch member 20 open or close in response to the vertical movement of the key top 14.

When the key top 14 is depressed by a keying operation, the biasing member 22 is elastically deformed in a buckling mode due to the dome shape thereof, so that an elastic biasing force is exerted to the key top 14, which assumes non-linear relationship with a displacement of the key top 14. As a result, the key switch 10 can establish unique keying operation properties, accompanied by a so-called click feeling, such that when the amount of depression of the key top 14 exceeds a predetermined value, the biasing force in a return direction, which has been gradually increased until that time, is abruptly reduced.

The key switch 10 is provided in itself with a protection function making it possible to reliably and stably prevent foreign matter, such as dust, liquid, etc., from penetrating the internal structure of the key switch (i.e., the link members 16, the switch member 20, etc.). More specifically, the key switch 10 includes a protection member 56 inserted and disposed between the base section 12 and the key top 14 at a position where the protection member 56 surrounds the pair of link members 16, the contact section 18 of the switch member 20, and the biasing member 22. The protection member 56 is an annular rubber element capable of being elastically deformed in response to the downward movement of the key top 14. Between the base section 12 and the key top 14, the protection member 56 is elastically deformed to follow the vertical movement of the key top 14, and maintains the posture thereof to continuously surround the pair of link members 16, the contact section 18 and the biasing member 22. As a result, during the vertical movement of the key top 14, the protection member 56 reliably and stably protects the link members 16, the contact section 18 and the biasing member 22 from the penetration of the foreign matter (see FIGS. 2 and 5).

The protection member 56 includes a tubular part 58 having a generally rectangular shape as seen in a plan view and exhibiting a major protection function against the foreign matter, and a sheeting part 60 connected with one end (a bottom end, in the drawing) of the tubular part 58. The tubular part 58 is provided, at an intermediate point in a height direction thereof, with a stepped area 58*a* through which a radial dimension changes locally. The sheeting part 60 is provided with an opening 60*a* formed to communicate with an internal space of the tubular part 58. In this connection, the tubular part 58 and the sheeting part 60, of the protection member 56, may be formed integrally or unitarily with each other, or alternatively, may be formed as separate members adapted to be securely attached to each other by, e.g., an adhesive (FIGS. 2 and 5 show the protection member 56 in which the tubular part 58 and the sheeting part 60 are unitarily formed).

In the key switch 10 configured as described above, the protection member 56 is provided separately from the biasing member 22, both being similar rubber elements adapted to be elastically deformed to follow the vertical movement of the key top 14, and solely for the purpose of protecting the internal structure of the key switch from the penetration of foreign matter, so that it is possible to prepare the protection member 56 having optimal properties capable of exhibiting the function for preventing the penetration of foreign matter at a required level. Therefore, in the key switch 10 adapted to be preferably used for a low-profile keyboard and including, as a directing structure for the key top 14, the pair of link members 16 interlocked with each other in an openable and closable manner about a mutually joined point (or the teeth 48, 50, in the illustrated embodiment), it is possible to ensure a more stricter protection function capable of reliably and stably preventing the foreign matter from penetrating the internal structure. As a result, it is possible to provide the key switch 10 having excellent operability and structural reliability, which can effectively prevent the keying operation properties of the key top 14 from being affected, or the accuracy of the opening or closing action of the contact section 18 from being deteriorated, by the existence of foreign matter. Further, the key switch 10 according to the present invention can be configured only by adding the protection member 56 to a conventional key switch having a low-profile structure, so that it is possible to inhibit an increase in manufacturing costs.

It is extremely advantageous that the protection member 56 has properties such as to be readily deformed to accurately follow the vertical movement of the key top 14 without substantially affecting a keying operation feeling given by the elastic biasing force of the biasing member 22 applied to the key top 14. In this arrangement, the movement of the key top 14 to return to the initial position is determined substantially only by the elastic restoring force generated in the biasing member 22. These properties of the protection member 56 are obtained mainly depending on the attributes of the tubular part 58, such as the shape, dimensions, material, etc. According to this configuration, in spite of the provision of the protection member 56 interposed between the base section 12 and the key top 14, it is possible to ensure the high-level protection function against the foreign matter, while eliminating the influence on the keying operation properties of the key switch 10 (i.e., without causing an uncomfortable feeling to the operator during the keying operation).

The protection member 56 is arranged so that the bottom end of the tubular part 58 and the sheeting part 60 contact the upper surface 26*a* of the second support plate 26, at a location outside the pair of slide support sections 30 provided on the second support plate 26 of the base section 12 (FIG. 2). Thus, the protection member 56 continuously surrounds the opening 28 of the base section 12, provided for allowing the biasing member 22 to be disposed adjacent to the contact section 18 of the switch member 20, as well as the slide support sections 30 (in particular, the guide grooves 32) of the base section 12, provided for slidably supporting the link members 16, during the vertical movement of the key top 14, so as to reliably protect them from the penetration of foreign matter. As a result, it is possible to effectively prevent the keying operation properties of the key top 14 from being affected, or the accuracy of the opening or closing action of the contact section 18 from being deteriorated, by the existence of foreign matter.

Also, the protection member 56 is arranged so that the top end 58*b* of the tubular part 58 contacts the inner surface 14*b* of the key top 14, at a location outside the link support member 34 provided on the inner surface 14*b* of the key top 14 (FIG. 2). Thus, the protection member 56 continuously surrounds the link support member 34 (in particular, the bearing holes or pivot support sections 36) of the key top 14 for pivotably joining the link members 16, during the vertical movement of the key top 14, so as to reliably protect it from the penetration of foreign matter. As a result, it is possible to effectively prevent the keying operation properties of the key top 14 from being affected by the existence of foreign matter.

Further, it is advantageous that, when the key top 14 is located at the above-described upper limit position of the vertical movement, the protection member 56 receives initial pressure from the base section 12 and the key top 14. In this configuration, even when the key switch 10 is not used, the protection member 56 is stably retained between the base section 12 and the key top 14 in a slightly and elastically deformed state, and therefore, it is possible, in particular, to prevent the sheeting part 60 from being floated or turned up over the base section 12 and thus to eliminate an undesirable situation in which foreign matter can penetrate between the sheeting part 60 and the base section 12.

In this connection, the protection member 56 described above can preferably be applied not only to the illustrated key switch 10, but also to, e.g., a conventional key switch including link members of a so-called pantograph type. Also in this arrangement, it is possible to provide a key switch having excellent operability and structural reliability, and which provides protection for reliably and stably preventing foreign matter from penetrating the internal structure.

In the key switch 10, the link support member 34 provided on the key top 14 includes a flat major plate portion 62 having a generally rectangular shape as seen in a plan view, and a pair of opposing wall portions 64 provided uprightly along a pair of edges of the major plate portion 62 and generally parallel with each other, each of the opposing wall portions 64 being provided with two bearing holes 36 (FIG. 3). The opposing wall portions 64 are spaced apart from each other by a distance permitting the second end region (including the pivoting axles 46) of each link member 16 to be stably inserted between the wall portions 64 without substantial wobbling (see FIG. 6A). Further, each bearing hole 36 is formed as a through hole with no notch, in a periphery of the hole, extending up to the outer edge of the opposing wall portion 64, and smoothly and rotatably receives the cylindrical pivoting axle 46 of the corresponding link member 16. In this connection, the bearing hole 36 is desirably formed as a circular hole as illustrated, but may be formed as a polygonal hole, on the condition that the bearing holes 36 do not interfere with the smooth rotation of the pivoting axles 46.

According to the provision of the link support member 34 configured as described above, in the key switch 10, the pivoting axles 46 of the link members 16 can be supported more stably in the bearing holes 36 of the link support member 34 while reliably preventing the disengagement of the pivoting axles 46, in comparison with a conventional key switch in which a pivotable support section of the key top, to which a link member is pivotably joined, is provided with a through hole having a notch. Thus, even when external force is applied to an outer periphery 14*c* of the key top 14 (FIGS. 1 and 2) in a direction pulling-up the key top 14 apart from the base section 12, it is possible to reliably prevent the pivoting axles 46 of the link members 16 from being disengaged from the bearing holes 36 of the link support member 34. If the external force is excessively large, the link support member 34 can be detached from the key top 14 so as to prevent the link support member 34 from being damaged. As a result, it is possible to provide the key switch 10 having excellent operability and structural reliability, which can effectively prevent the key top 14 from being unexpectedly detached.

In order to surely prevent external force from being unintentionally applied to the outer periphery 14*c* of the key top 14 in the direction pulling-up the key top 14 from the base section 12, the sheeting part 60 of the protection member 56 may be provided, as shown in FIG. 2, with an annular projection 66 spaced apart from the outer periphery 14*c* of the key top 14. In this arrangement, the projection 66 and the sheeting part 60 may be formed integrally or unitarily as illustrated, or alternatively, a projection 66 as a separate member may be securely attached to the sheeting part 60 by an adhesive, etc.

In order to allow the key switch 10 to be safely and easily assembled, the link support member 34 has, at least in the major plate portion 62 thereof, an elasticity permitting the pair of pivoting axles 46 of each link member 16 to be received in the corresponding bearing holes 36 provided in the pair of opposing wall portions 64. An operation for attaching the link members 16 to the link support member 34, performed in an assembling process of the key switch 10, will be described below.

Figure 6A:
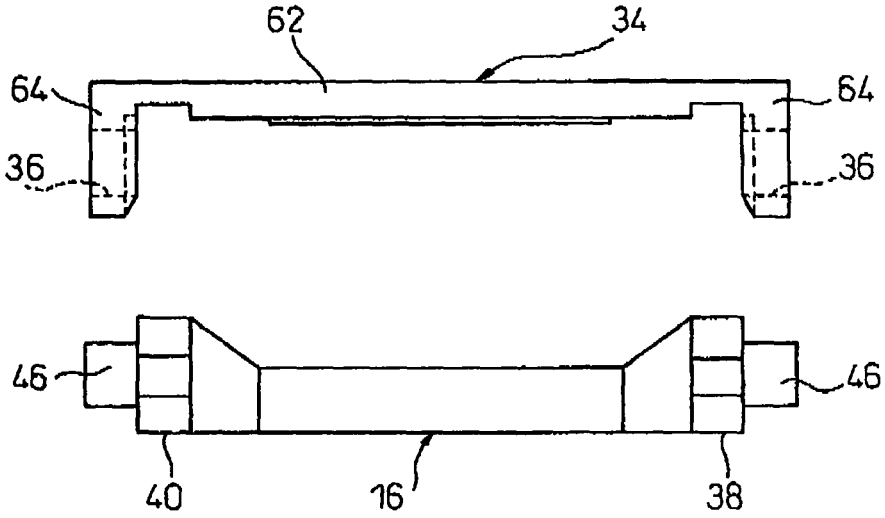
FIG. 6A is an illustration for describing a function of the link support member in the key switch of FIG. 1, and schematically showing a configuration before the link members are joined to the link support member.
Figure 6B:
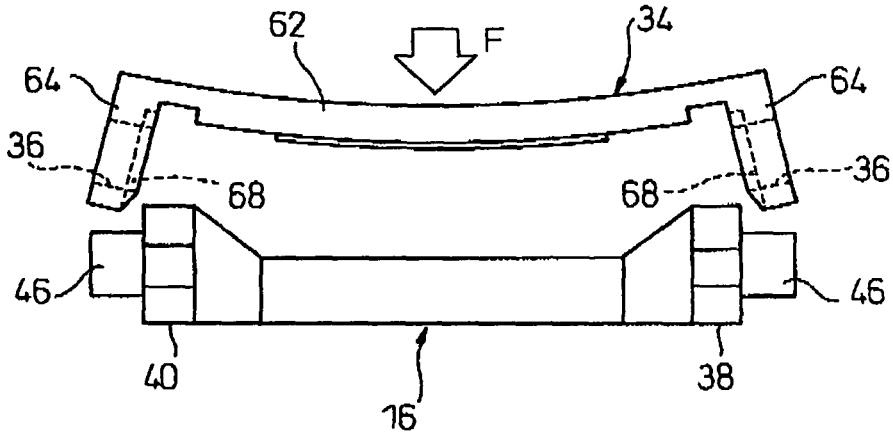
FIG. 6B is an illustration for describing a function of the link support member in the key switch of FIG. 1, and schematically showing a configuration during an act for joining the link members to the link support member.

In a normal state, the link support member 34 is dimensioned so that a space between the pair of opposing wall portions 64 is substantially equal to a distance between the outer surfaces of the arms 38, 40 of each link member 16, to an extent not to interfere with a smooth sliding between the link members 16 and the opposing wall portions 64 (FIG. 6A). In the assembling process of the key switch 10, the link support member 34 as a separate piece is attached to the second end regions of the pair of link members 16. At this time, while the outer edges of the opposing wall portions 64 of the link support member 34 are pressed against the pair of pivoting axles 46 of each link member 16, pressing force F is further applied to the major plate portion 62 of the link support member 34 (FIG. 6B). As a result, the major plate portion 62 is inwardly convexly curved, and thus the space between the opposing wall portions 64 is expanded in a dovetail manner, so that, by continuously applying the pressing force F, the pivoting axles 46 are fitted into the corresponding bearing holes 36. Thereafter, when pressing force F is released, the major plate portion 62 is elastically restored to its original flat shape, and the opposing wall portions 64 return to the normal positions ensuring a mutually parallel arrangement, so that the pivoting axles 46 of each link member 16 are stably supported in the bearing holes 36 of the link support member 34.

In the above-described attaching operation, the link members 16 may be attached to the link support member 34 sequentially one by one, or alternatively, both of the link members 16 may be simultaneously attached to the link support member 34. In the latter case, the pair of link members 16 with the respective tooth 48 being meshed with the respective teeth 50 are laid on, e.g., the base section 12 in a flat state (FIG. 5), and the link support member 34 is pressed on these link members 16 so as to be attached to the link members 16. It is advantageous that the link support member 34 has guide channels 68 on mutually opposing inner surfaces of the opposing wall portions 64 as shown in FIG. 3, so that the pair of pivoting axles 46 of each link member 16 can be smoothly inserted between the opposing wall portions 64 and accurately fitted into the corresponding bearing holes 36.

After the link support member 34 is attached to the pair of link members 16 as described above, the key top 14 is attached to the link support member 34. To this end, the inner surface 14*b* of the key top 14 is provided with a plurality of hooks 70 for securely retaining the link support member 34 at a predetermined position on the inner surface 14*b* (see FIG. 7). The hooks 70 uprightly project from the inner surface 14*b* of the key top 14, and are detachably engaged, at respective hooking-ends 70*a* formed at the distal ends thereof, with an outer periphery of the major plate portion 62 of the link support member 34. In the assembling process of the key switch 10, the key top 14 is disposed over and pressed on the link support member 34 attached to the pair of link members 16 laid in the flat state, so that it is possible to bring the major plate portion 62 of the link support member 34 into engagement with the hooks 70 in a snap-fit manner while slightly and elastically deforming the major plate portion 62.

Figure 7:
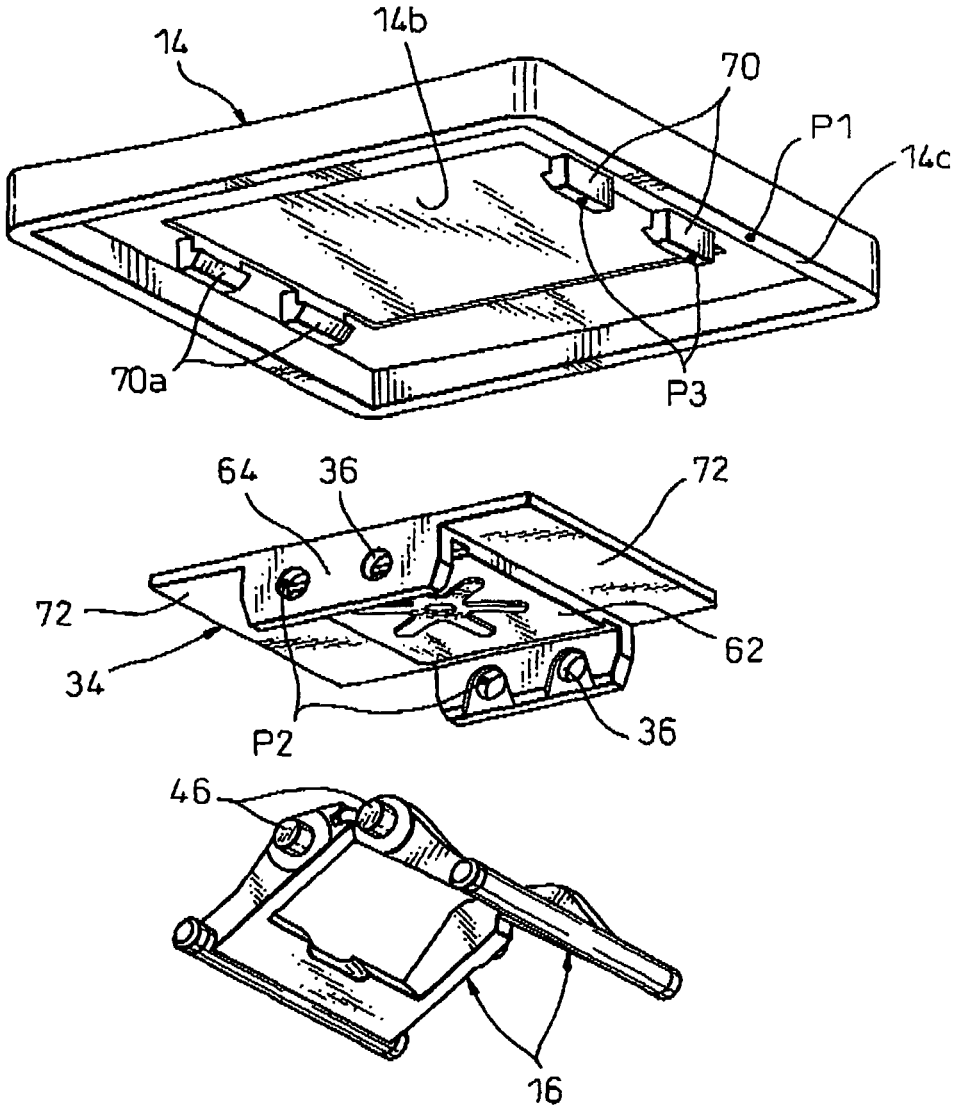
FIG. 7 is an exploded perspective bottom-side view showing a modification of the link support member in the key switch of FIG. 1 together with a key top and the link members.

In this connection, as shown in FIG. 7, in order to ensure areas used for an engagement with the hooks 70, the major plate portion 62 of the link support member 34 may be provided with extensions 72 horizontally extending outward from edges other than the edges having the opposing wall portions 64. This configuration, in which the hooks 70 are engaged with the extended portions 72, shows geometrical properties, when the external force is applied to, e.g., the outer periphery 14*c* of the key top 14 in a direction pulling-up the key top 14 from the base section 12, such that a ratio of a distance between a fulcrum P2 and an application point P3 to a distance between a force point P1 and the fulcrum P2, with regard to the force point P1 (i.e., the outer periphery 14*c*), the fulcrum P2 (i.e., the bearing holes 36 farther from the force point P1) and the application point P3 (i.e., the hooks 70 closer to the force point P1), is greater than a ratio of a distance between a fulcrum and an application point to a distance between a force point and the fulcrum, with regard to the force point (i.e., the outer periphery of the key top), the fulcrum (i.e., one pivot support section farther from the force point) and the application point (i.e., another pivot support section closer to the force point) defined in the conventional key switch. As a result, in the key switch 10, force generated at the application point P3 (i.e., force acting to disengage the hooks 70 closer to the force point P1 from the major plate portion 62) is reduced in comparison with a force generating in the conventional key switch if external force of identical magnitude is applied, and therefore, it is possible to more effectively prevent the key top 14 from being detached from the link support member 34 or the hooks 70 from being damaged due to the detachment of the key top.

Figure 8A:
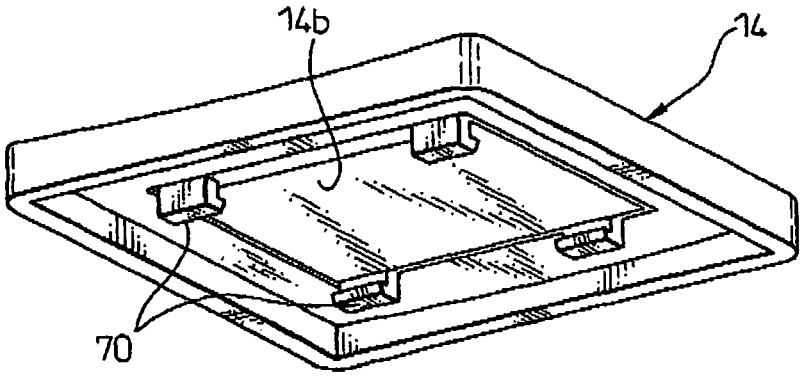
FIG. 8A is a perspective bottom-side view showing a first modification of the key top of the FIG. 7.
Figure 8B:
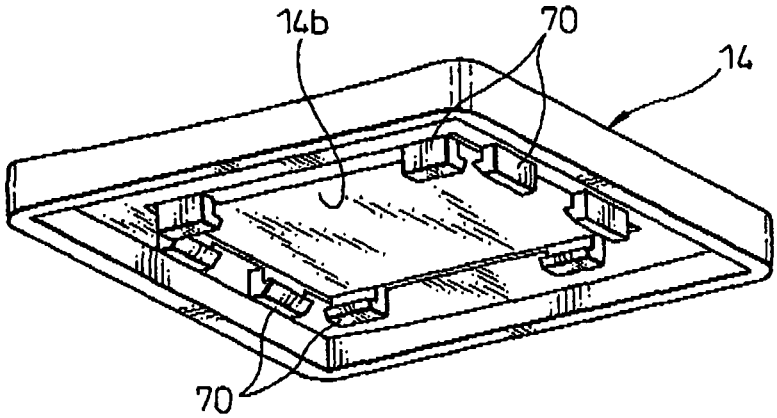
FIG. 8B is a perspective bottom-side view showing a second modification of the key top of the FIG. 7.

As shown in FIG. 7, the plurality of hooks 70 provided on the inner surface 14*b* of the key top 14 may be configured as a set of hooks 70 cooperating with each other to securely retain the link support member 34 and located so as to face to each other in a direction orthogonal to the pivoting axis 52 (FIG. 1) of each link member 16 (two pairs of hooks 70 are provided, in the drawing). Alternatively, as shown in FIG. 8A, the plurality of hooks 70 may be configured as a set of hooks 70 cooperating with each other to securely retain the link support member 34 and located so as to face to each other in a direction parallel to the pivoting axis 52 (FIG. 1) of each link member 16 (two pairs of hooks 70 are provided, in the drawing). Also, as shown in FIG. 8B, four pairs of hooks 70 may be provided to be located so as to face to each other in both directions orthogonal and parallel to the pivoting axis 52 (FIG. 1) of each link member 16. The disposition and number of the hooks 70 may be optimized in consideration of, e.g., a size of the key top 14, a position along the outer periphery 14*c* of the key top 14 that are likely to be the above-described force point during use, and the like.

The above-described configuration of the link support member 34 and the corresponding configuration of the hooks 70 of the key top 14 can preferably be applied not only to the illustrated key switch 10 but also to, e.g., a conventional key switch that does not have the protection member 56. Also in this arrangement, it is possible to provide a key switch having excellent operability and structural reliability, which can prevent the key top from being unexpectedly detached.

Figure 9:
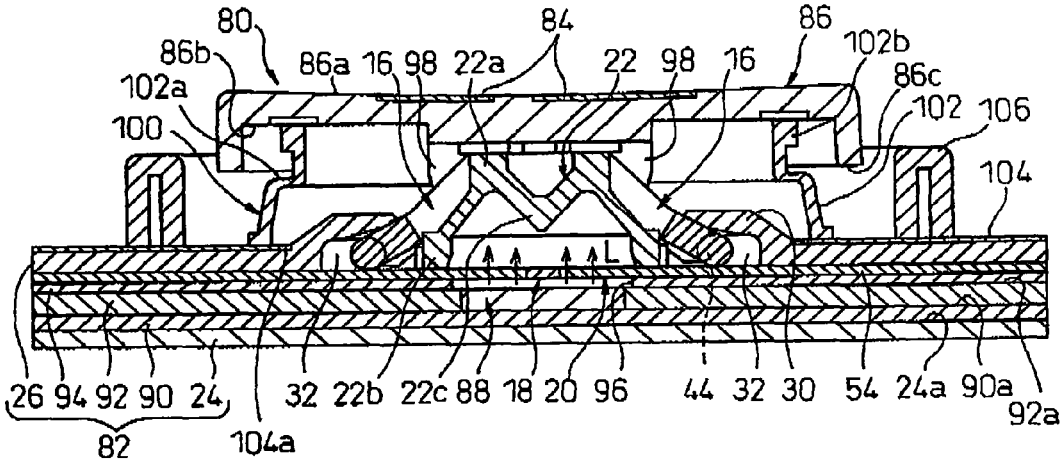
FIG. 9 is a sectional view showing a key switch according to another embodiment of the present invention, in an assembled state wherein a key top is not operated.
Figure 10:
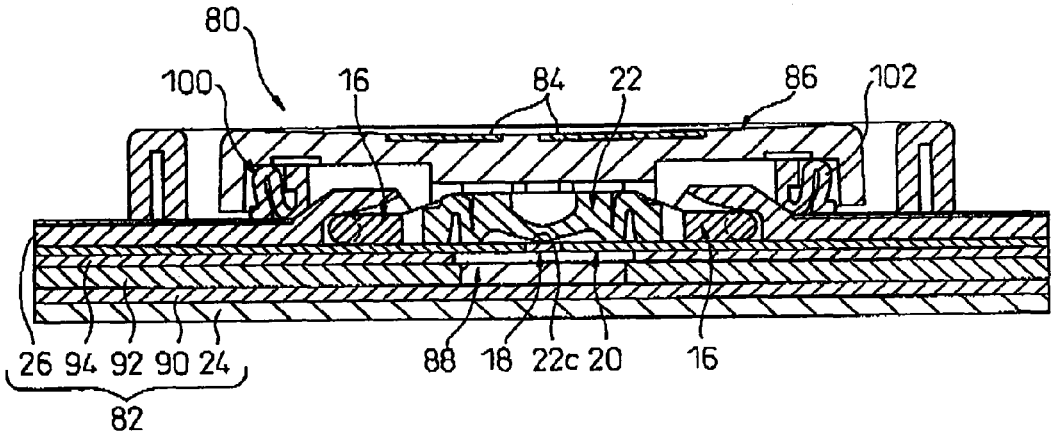
FIG. 10 is a sectional view showing the key switch of FIG. 9, in an assembled state wherein the key top is operated.

FIGS. 9 and 10 show a key switch 80 according to another embodiment of the present invention. The key switch 80 includes several components substantially identical to those of the key switch 10 according to the first embodiment, and therefore, the corresponding components are denoted by common reference numerals and the descriptions thereof are not repeated.

The key switch 80 includes a base section 82, a key top 86 disposed above the base section 82 and including an optically transparent marked region 84; a pair of link members 16 interlocked to each other to support and direct the key top 86 in an upward-and-downward direction (i.e., a substantially vertical direction) relative to the base section 82; a switch member 20 including a contact section 18 capable of opening and closing in response to an upward-and-downward movement (or a vertical movement) of the key top 86; and a light-emitting section 88 provided in the base section 82 and that generating light L transmitted through the marked region 84 of the key top 86. The key switch 80 also includes a biasing member 22 capable of applying an elastic biasing force in a vertically upward direction (i.e., an initial-position recovering force) to the key top 86, and capable of making the contact section 18 of the switch member 20 open or close in response to the vertical movement of the key top 86. The key top 86 is movable in the vertical direction relative to the base section 82, through an interlocking action of the link members 16, while keeping a predetermined posture of the key top 86.

The base section 82 has a laminated structure that includes, in addition to the first and second support plates 24, 26 of the base section 12 in the key switch 10, a circuit board 90 placed on the upper surfaces 24*a* of the first support plates 24, a third support plate 92 placed on the upper surface 90*a* of the circuit board 90, and a fourth support plate 94 placed on the upper surface 92*a* of the third support plate 92. The circuit board 90 is configured as, e.g., a flexible circuit board, and a LED (light-emitting diode, not shown) acting as a light source of the light-emitting section 88 is mounted at a desired position (a center position, in the drawing) of the circuit board 90. As the light source of the light-emitting section 88, various light emitting elements, such as an organic EL (electroluminescence) element, may be used in place of the LED.

The third support plate 92 is a shin plate made of metal or resin, and the light-emitting section 88 is formed therein at a position beneath the key top 14. For example, in the case where the LED mounted on the circuit board 90 is located at a position of the light-emitting section 88, the light-emitting section 88 formed in the third support plate 92 is structured as a through hole, a mesh structure, a transparent region, etc., capable of transmitting the light emitted from the LED with substantially no obstruction. On the other hand, in the case where the LED mounted on the circuit board 90 as the light source is located at a position remote from the key switch 10, the third support plate 92 is configured as a light-guiding plate made of a resinous material having desired light-guiding properties. In this case, the light-emitting section 88 is provided with a reflecting structure having a dotted pattern and capable of directing (or changing the traveling direction of)

the light propagating through the third support plate 92 as the light-guiding plate from the LED as the light source toward the key top 14.

The fourth support plate 94, placed on the third support plate 92, cooperates with the second support plate 26 so as to hold therebetween the membrane switch sheet 54 constituting the switch member 20. The fourth support plate 94 is provided with an opening 96 formed at a position superimposed on the light-emitting section 88, so as not to interfere with the propagation of the light emitted from the light-emitting section B8 provided in the third support plate 92. The opening 96 is disposed at a position superimposed on the contact section 18 formed in the membrane switch sheet 54, and thus may actually include a plurality of beams or columns to provide a backside support for the contact section 18, effectively acting when the key top 14 is depressed. Further, the membrane switch sheet 54 is formed transparently or translucently at least at a portion thereof superimposed on the opening 96 of the fourth support plate 94, so as not to interfere with the propagation of the light emitted from the light-emitting section 88.

Similarly to the key top 14 in the key switch 10, the key top 86 includes an operating surface 86*a* and an inner surface 86*b*. The key top 86 does not use the link support member 34 and, at a predetermined position on the inner surface 86*b*, pivot support sections 98 are formed for pivotably receiving the second end (or top end) regions of the respective link members 16. Each pivot support section 98 has, for example, a bearing hole formed as a through hole with a notch (not shown). In place of this configuration, the link support member 34 may be attached to the inner surface 86*b* of the key top 86 in a manner similar to the key switch 10.

The key top 86 is preferably formed as an integral or unitary piece, which is made of a transparent or translucent resinous material having light transmittance. A primary coating with a desired color is applied to the surface of the key top, and a finish coating with a dark color, such as black, is applied over the primary coating. Through, e.g., a marking process using laser, a desired part of the finish coating is locally removed, so as to form the desired marked region 84 such as a character, symbol, etc. The marked region 84 thus obtained can transmit light L, emitted from the light-emitting section 88, from the inner surface 86*b* to the operating surface 86*a* of the key top 86.

Similarly to the biasing member 22 in the key switch 10, the biasing member 22 is disposed between the key top 86 and the membrane switch sheet 54. In other words, the biasing member 22 is disposed midway in the propagation path of the light L from the light-emitting section 88 to the marked region 84. Therefore, the biasing member 22 is made of a transparent or translucent material capable of transmitting light L. As a result, light L emitted from the light-emitting section 88 is transmitted through the biasing member 22 and reliably reaches the marked region 84 of the key top 86.

In the key switch 80, similarly to the key switch 10, when no external force is applied to the key top 86, the biasing member 22 biases the key top 86 toward and supports it, by the dome top 22*a*, at the upper limit position of the stroke vertically above and apart from the base section 86 (FIG. 9). At this time, the contact section 18 of the membrane sheet 54 is in an opened state. When the key top 86 is depressed by a keying operation, the biasing member 22 is elastically deformed in response the downward movement of the key top 86, while exerting an elastic biasing force (or an initial-position recovering force) to the key top 86 in an upward direction, and presses by the inside projection 22*c* the membrane switch sheet 54 from the outside thereof, when the key top 86 reaches the lower limit position of the stroke, so as to close the contact section 18 (FIG. 10).

When the depressing force to the key top 86 is released, the biasing member 22 is elastically restored so as to return the key top 86 to the upper limit position, and thereby the membrane switch sheet 54 is restored to open the contact section 18.

The key switch 80 possesses an internal light-shielding function permitting the light L emitted from the light-emitting section 88 to efficiently reach the marked region 84, in the configuration such that the marked region 84, such as a character, symbol, etc., of the key top 86 is illuminated from the inside of the key switch (so-called a backlight configuration). More specifically, the key switch 80 includes a light-shielding member 100 disposed and inserted between the base section 82 and the key top 86 at a position where the light-shielding member 100 does not interfere with the propagation of the light L from the light-emitting section 88 to the marked region 84. The light-shielding member 100 is an annular rubber element capable of being elastically deformed in response to the downward movement of the key top 86. Between the base section 82 and the key top 86. The light-shielding member 100 is elastically deformed to follow the vertical movement of the key top 86, and maintains the posture thereof to continuously surround the pair of link members 16, the contact section 18 of the switch member 20, and the biasing member 22. As a result, during the vertical movement of the key top 86, the light-shielding member 100 reliably and stably prevents the light L from escaping through a gap between the base section 82 and the key top 86 to the outside of the key switch (see FIGS. 9 and 10).

The light-shielding member 100 is configured similarly to the protection member 56 in the key switch 10. More specifically the light-shielding member 100 includes a tubular part 102 having a generally rectangular shape as seen in a plan view and exhibiting a major light-shielding function against the light L, and a sheeting part 104 connected with one end (a bottom end, in the drawing) of the tubular part 102. The tubular part 102 is provided, at an intermediate point in a height direction thereof, with a stepped area 102*a* through which a radial dimension changes locally. The sheeting part 104 is provided with an opening 104*a* formed to communicate with an internal space of the tubular part 102. In order to reliably prevent the escape of the light L, the light-shielding member 100 or at least the tubular part 102 thereof is formed to have an opaque or light-intransmittable color.

In this connection, the tubular part 102 and the sheeting part 104, of the light-shielding member 100, may be formed integrally or unitarily with each other, or alternatively, may be formed as separate members adapted to be securely attached to each other by, e.g., an adhesive (FIGS. 9 and 10 show the light-shielding member 100 in which the tubular part 102 and the sheeting part 104 as the separate members are securely attached to each other). Further, the sheeting part 104 of the light-shielding member 100 may be provided with an annular projection 106 spaced apart from the outer periphery 86*c* of the key top 86, so as to surely prevent external force from being unintentionally applied to the outer periphery 86*c* of the key top 86 in a direction pulling-up the key top 66 from the base section 82. Also in this arrangement, the projection 106 as a separate member may be securely attached to the sheeting part 104 by an adhesive, etc., as illustrated, or alternatively, the projection 106 and the sheeting part 104 may be formed integrally or unitarily.

In the key switch 80 configured as described above, the light-shielding member 100 is provided separately from the biasing member 22, both being similar rubber elements adapted to be elastically deformed to follow the vertical movement of the key top 86, and solely for the purpose of preventing light L from escaping from the inside of the switch, so that it is possible to prepare the light-shielding member 100 having optimal properties capable of exhibiting the function for preventing the escape of the light at a required level. Therefore, in the key switch 80 adapted to be preferably used for a low-profile keyboard and including, as a directing structure for the key top 86, the pair of link members 16 interlocked with each other in an openable and closable manner about a mutually joined point (or the teeth 48, 50, in the illustrated embodiment), it is possible to ensure a high-level internal light-shielding function capable of reliably and stably preventing light L as a backlight from escaping through the gap between the base section 82 and the key top 86. As a result, it is possible to provide the key switch 80 having excellent operability and structural reliability, which can permit light L emitted from the light-emitting section 88 to efficiently reach the marked region 84 so as to improve visibility of the marked region 84. Further, the key switch 80 according to the present invention can be configured only by adding the light-shielding member 100 to a conventional key switch having a low-profile structure, so that it is possible to decrease manufacturing costs.

It is extremely advantageous that the light-shielding member 100 has properties such as to be readily deformed to accurately follow the vertical movement of the key top 86 without substantially affecting a keying operation feeling given by the elastic biasing force of the biasing member 22 applied to the key top 86. In this arrangement, the movement of the key top 86 to return to the initial position is determined substantially only by the elastic restoring force generated by the biasing member 22. These properties of the light-shielding member 100 are obtained mainly depending on attributes of the tubular part 102, such as the shape, dimensions, material, etc. According to this configuration, in spite of the provision of the light-shielding member 100 interposed between the base section 82 and the key top 86, it is possible to ensure the high-level light-shielding function against the light as a backlight, while eliminating the influence on the keying operation properties of the key switch 80 (i.e., without causing an uncomfortable feeling to the operator during the keying operation).

The protection member 100 is arranged so that the bottom end of the tubular part 102 and the sheeting part 104 contact the upper surface 26*a* of the second support plate 26, at a location outside the pair of slide support sections 30 provided on the second support plate 26 of the base section 82 (FIG. 9). Thus, the light-shielding member 100 continuously surrounds the opening 28 of the second support plate 26 of the base section 82, provided for allowing the biasing member 22 to be disposed adjacent to the switch member 20 (FIG. 1), as well as the slide support sections 30 (in particular, the guide grooves 32) of the second support plate 26 of the base section 82, provided for slidably supporting the link members 16, during the vertical movement of the key top 86, so as to reliably prevent the light L diffusing through these components from escaping to the outside of the key switch.

Also, it is advantageous that, when the key top 86 is located at the above-described upper limit position of the vertical movement, the light-shielding member 100 receives initial pressure from the base section 82 and the key top 86. In this configuration, even when the key switch 80 is not used, the light-shielding member 100 is stably retained between the base section 82 and the key top 86 in a slightly and elastically deformed state, and therefore, it is possible, in particular, to prevent the sheeting part 104 from being floated or turned up over the base section 82 and thus eliminate an undesirable situation in which the light L from the light-emitting section 88 escapes through a gap between the sheeting part 104 and the base section 82.

In this connection, the light-shielding member 100 described above can preferably be applied not only to the illustrated key switch 80, but also to, e.g., a conventional key switch including link members of a so-called pantograph type. Also in this arrangement, it is possible to provide a key switch having excellent operability and structural reliability, which can possess an internal light-shielding function permitting light as a backlight to efficiently reach the marked region of the key top.

Figure 11:
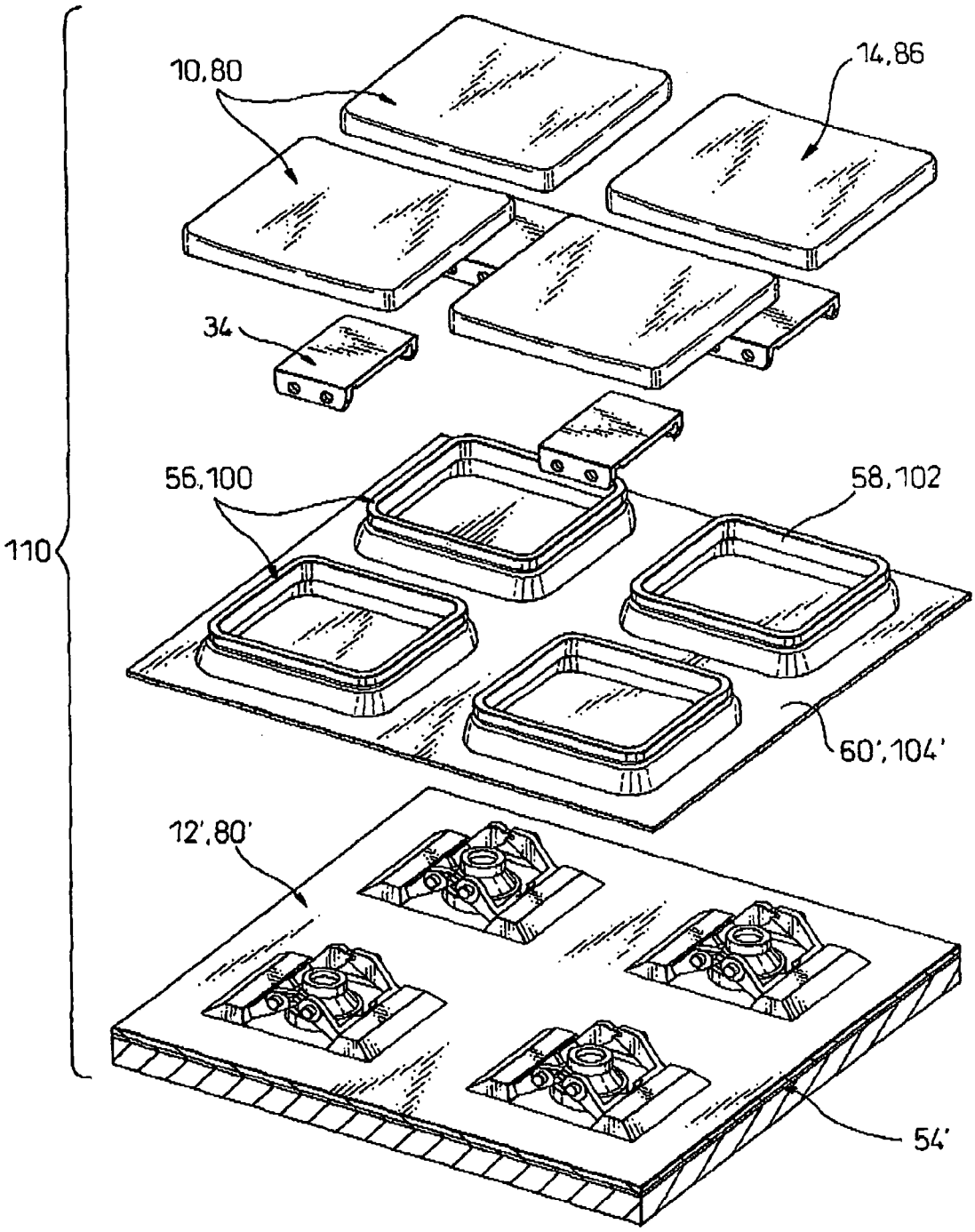
FIG. 11 is an exploded perspective partial view showing main components of a keyboard according to an embodiment of the present invention.

FIG. 11 shows, by a schematic exploded view, a keyboard 110 according to an embodiment of the present invention, which includes a plurality of key switches 10 (or 80) arranged in a predetermined array. The keyboard 110 has a low-profile configuration capable of being used as an input device of a portable electronic apparatus, such as a notebook or palmtop personal computer, etc. In the keyboard 110, the base section 12 (or 82) and the membrane switch sheet 54 of the switch member 20 in each key switch 10 (or 80) are formed as a large-sized base section 12' (or 82') and a large-sized membrane switch sheet 54', respectively, which are shared by all of the key switches 10 (or 80) incorporated into the keyboard 110. Further, the sheeting part 60 (or 104) of the protection member 56 (or the light-shielding member 100) in the key switch 10 (or 80) is formed as a large-sized sheet member 60' (or 104') shared by all of the key switches 10 (or 80). Still further, each key switch 10 (or 80) includes the link support member 34 attached to the key top 14 (or 86). The keyboard 110 configured as described above has a low-profile configuration, which also has excellent operability and structural reliability.

Figure 12:
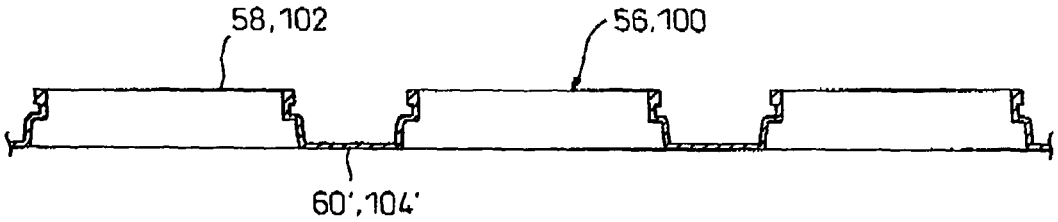
FIG. 12 is a sectional view showing a protection/light-shielding member used in the keyboard of FIG. 11.

As shown in FIG. 12, the keyboard 110 may be configured so that the tubular parts 58 (or 102) of the protection members 56 (or the light-shielding members 100) of the respective key switches 10 (or 80) are previously formed integrally or unitarily with the large-sized sheet member 60' (or 104'). Thus, in this case, each of the protection members 56 (or the light-shielding members 100) of the key switches 10 (or 80) is provided unitarily with the sheet member 60' (or 104') extending over a range covering these key switches 10 (or 80).

Figure 13A:
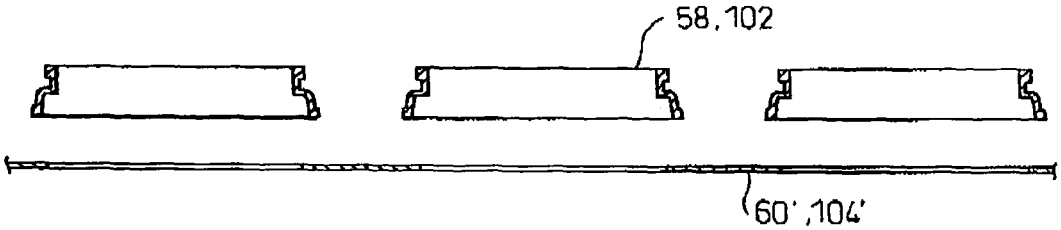
FIG. 13A is a sectional view showing a modification of the protection/light-shielding member in a state before being assembled.
Figure 13B:
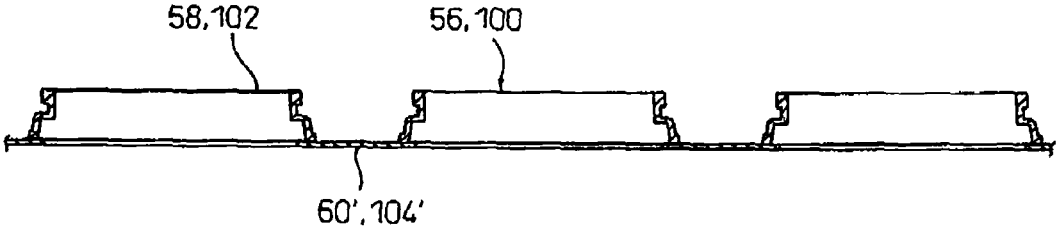
FIG. 13B is a sectional view showing the modification of the protection/light-shielding member in a state after being assembled.

Alternatively, as shown in FIG. 13, the tubular parts 58 (or 102) of the protection members 56 (or the light-shielding members 100) of the respective key switches 10 (or 80) may be previously formed separately from the large-sized sheet member 60' (or 104') (FIG. 13A), and in a subsequent process, the tubular parts 58 (or 102) may be securely attached to the sheet member 60' (or 104') by an adhesive, etc. (FIG. 13B). Thus, in this case, each of the protection members 56 (or the light-shielding members 100) of the key switches 10 (or 80) is securely attached to the separate sheet member 60' (or 104') extending over a range covering these key switches 10 (or 80).

While the invention has been described with reference to specific preferred embodiments, it will be understood by those skilled in the art that various changes and modifications may be made thereto without departing from the scope of the following claims.

The invention claimed is:

1. A key switch comprising:

a base section;

a key top disposed above said base section;

a pair of link members interlocked to each other to support and direct said key top in a vertical direction relative to said base section;

a switch member including a contact section capable of opening and closing in response to a vertical movement of said key top;

a biasing member capable of applying an elastic biasing force in a vertically upward direction to said key top; and an annular protection member including a tubular part having an open top end, the annular protection member being disposed and inserted between said base section and said key top at a position where said protection member surrounds said pair of link members, said contact section and said biasing member, the tubular part being disposed on a sheeting part of the annular protection member, the sheeting part further including an annular projection spaced apart from an outer periphery of the key top in an outward direction generally parallel to an operating surface of the key top, said key top including pivot support sections pivotably supporting said pair of link members, the open top end of said tubular part of said annular protection member contacting an inner surface of said key top at a location outside said pivot support sections, and said protection member being elastically deformed to follow said vertical movement of said key top and protecting said pair of link members, said pivot support sections, said contact section and said biasing member from penetration of foreign matter.

2. A key switch as set forth in claim 1, wherein said protection member has properties such as to be deformed to follow said vertical movement of said key top without affecting a keying operation feeling given by said elastic biasing force of said biasing member.

3. A key switch as set forth in claim 1, wherein said base section includes a slide support section slidably supporting each of said pair of link members; and wherein said protection member contacts at a bottom end thereof with an upper surface of said base section and protects said slide support section from said penetration of said foreign matter.

4. A key switch as set forth in claim 1, wherein said switch member comprises a membrane switch sheet disposed adjacent to said base section and carrying said contact section at a position beneath said key top; and wherein said biasing member is disposed between said key top and said membrane switch sheet, is elastically deformed in response to a vertical downward movement of said key top to generate said elastic biasing force, and presses said membrane switch sheet, when said key top reaches a lower limit position of said vertical movement, to close said contact section.

5. A key switch as set forth in claim 1, wherein said pair of link members are provided at respective one-end regions thereof with teeth meshable with each other in a gearing manner and pivoting axles pivotably joined to said key top, and at respective other-end regions of the link members with sliding axles slidably engaged with said base section.

6. A keyboard comprising a plurality of key switches in an array, each of said key switches being described in claim 1, wherein said protection member of each key switch is provided unitarily with a sheet member extending over a range covering said plurality of key switches.

7. A keyboard comprising a plurality of key switches in an array, each of said key switches being described in claim 1, wherein said protection member of each key switch is securely attached to a separate sheet member extending over a range covering said plurality of key switches.

* * * * *